US007072601B2

(12) United States Patent
Kakitani et al.

(10) Patent No.: US 7,072,601 B2
(45) Date of Patent: Jul. 4, 2006

(54) PROCESS CARTRIDGE, METHOD OF ASSEMBLING PROCESS CARTRIDGE, AND CONNECTING MEMBER

(75) Inventors: Masaki Kakitani, Shizuoka (JP); Isao Koishi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 10/957,616

(22) Filed: Oct. 5, 2004

(65) Prior Publication Data

US 2005/0220476 A1 Oct. 6, 2005

(30) Foreign Application Priority Data

Mar. 30, 2004 (JP) ..... 2004-099504
Sep. 21, 2004 (JP) ..... 2004-273534

(51) Int. Cl.
*G03G 15/00* (2006.01)

(52) U.S. Cl. ..... 399/90; 399/88; 399/111; 399/113

(58) Field of Classification Search ..... 399/88, 399/90, 111, 113, 109
See application file for complete search history.

(56) References Cited

U.S. PATENT DOCUMENTS 6,522,845 B1 * 2/2003 Sameshima ..... 399/88
6,571,070 B1 * 5/2003 Oguma et al. ..... 399/27
6,895,199 B1 * 5/2005 Sato et al. ..... 399/111

FOREIGN PATENT DOCUMENTS

JP 2000-112318 4/2000

* cited by examiner

*Primary Examiner*—Hoang Ngo
(74) *Attorney, Agent, or Firm*—Fitzpatrick, Cella, Harper & Scinto

(57) ABSTRACT

A process cartridge detachably mountable on a main body of an electrophotographic image forming apparatus, and including a first unit for supporting an electrophotographic photosensitive member and a charging member for acting on the photosensitive member, a second unit provided with a force imparting portion, an electrically conductive connecting member for pivotally connecting the first unit and the second unit together, and an electrically conductive member provided in the first unit, wherein the electrically conductive connecting member receives a bias to be supplied from the main body to the charging member when the process cartridge is mounted on the main body, the electrically conductive member is provided in contact with the connecting member to supply the charging member with the bias received by the connecting member when the process cartridge is mounted on the main body, and the force imparting portion imparts to the electrically conductive member an urging force for the electrically conductive member to urge the connecting member by the first unit and the second unit being moved relative to each other in the lengthwise direction thereof.

7 Claims, 14 Drawing Sheets

PROCESS CARTRIDGE, METHOD OF ASSEMBLING PROCESS CARTRIDGE, AND CONNECTING MEMBER

BACKGROUND OF THE INVENTION

1. Field of the Invention

The invention relates to a process cartridge, a method of assembling the process cartridge, and a connecting member for use in the assembly of the process cartridge.

Here, an electrophotographic image forming apparatus is an apparatus for forming an image on a recording medium (e.g. paper, an OHP sheet or the like) by the use of an electrophotographic image forming process. Examples of the electrophotographic image forming apparatus include, for example, an electrophotographic copying machine, an electrophotographic printer (e.g. a laser beam printer, an LED printer or the like), a facsimile apparatus and a word processor or the like.

Also, the process cartridge refers to at least one of charging means, developing means, cleaning means, etc. as process means and an electrophotographic photosensitive member integrally made into a cartridge, which is made detachably mountable on an electrophotographic image forming apparatus main body.

2. Description of the Related Art

In an electrophotographic image forming apparatus (hereinafter referred to as the image forming apparatus) using an electrophotographic image forming process, there has heretofore been adopted a process cartridge system in which an electrophotographic photosensitive member and process means acting on the electrophotographic photosensitive member are integrally made into a cartridge, which is made detachably mountable on an image forming apparatus main body. According to this process cartridge system, the maintenance of the apparatus can be carried out by a user himself without resort to a serviceman and therefore, operability could be markedly improved. So, this process cartridge system is widely used in image forming apparatuses.

As an example of such a process cartridge, there is one constituted by a cleaner unit having a photosensitive drum, a charging device and a cleaning device, and a developing unit having developing means for developing an electrostatic latent image on the photosensitive drum. Supporting holes are formed in the opposite ends of a cleaning frame the cleaning unit has. Also, connecting holes are formed in the opposite ends of a developing container unit the developing unit has. With the connecting holes and the supporting holes put together, pins are inserted from the opposite ends of the cleaner unit into the connecting holes and the supporting holes, whereby the developing unit and the cleaner unit are connected together.

Regarding the connection of the cleaner unit and the developing unit in the conventional process cartridge, there is known one in which a pin connects the cleaner unit and the-developing unit together and at the same time, is engaged with an electrode for supplying-electric power to a charging device (charging means) for charging the photosensitive drum (see Japanese Patent Application Laid-Open No. 2000-112318).

However, in a construction wherein a connecting member for connecting the cleaner unit and the developing unit together is used as an electric power supplying member, it has been required to more enhance the reliability of electric power supply.

SUMMARY OF THE INVENTION

So, it is an object of the present invention to provide a process cartridge in which the reliability of electric power supply to process means has been enhanced, a method of assembling the process cartridge, and a connecting member for use in the assembly of the process cartridge.

It is another object of the present invention to provide a process cartridge which is easy to assemble even in a construction wherein a connecting member used for the assembly of the process cartridge is used as an electric power supplying member, a method of assembling the process cartridge, and a connecting member for use for the assembly of the process cartridge.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described in greater detail with reference to the drawings.

First Embodiment (1) General Construction of an Image Forming Apparatus

Figure 1:
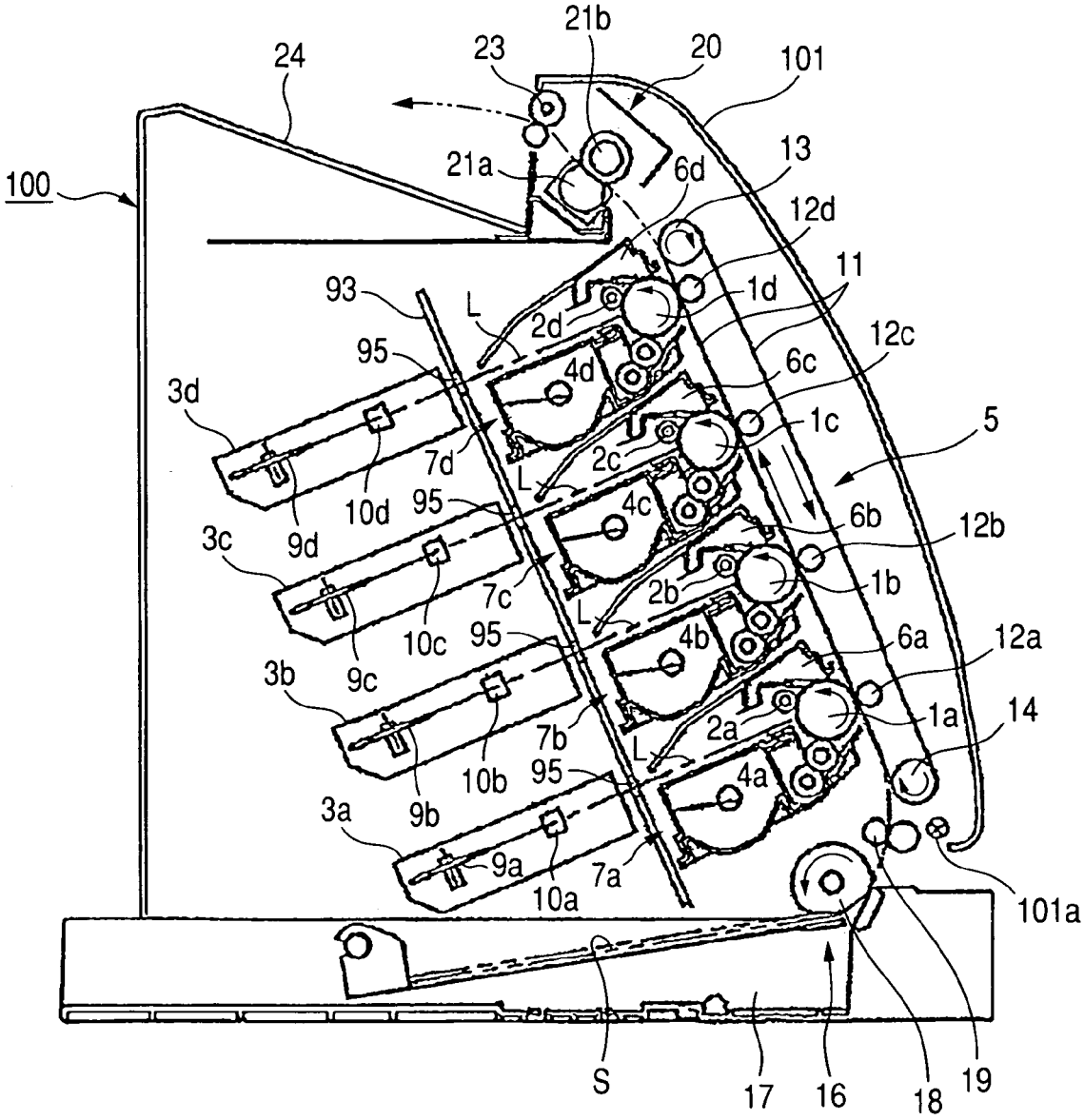
FIG. 1 is a longitudinal cross-sectional view illustrating a full-color image forming apparatus according to an embodiment of the present invention.

FIG. 1 is a cross-sectional view showing the general construction of a full-color image forming apparatus according to an embodiment of the present invention. This full-color image forming apparatus is a full-color laser beam printer of a vertical tandem type and a process cartridge detachably mountable type using a transfer type electrophotographic process.

Figure 2:
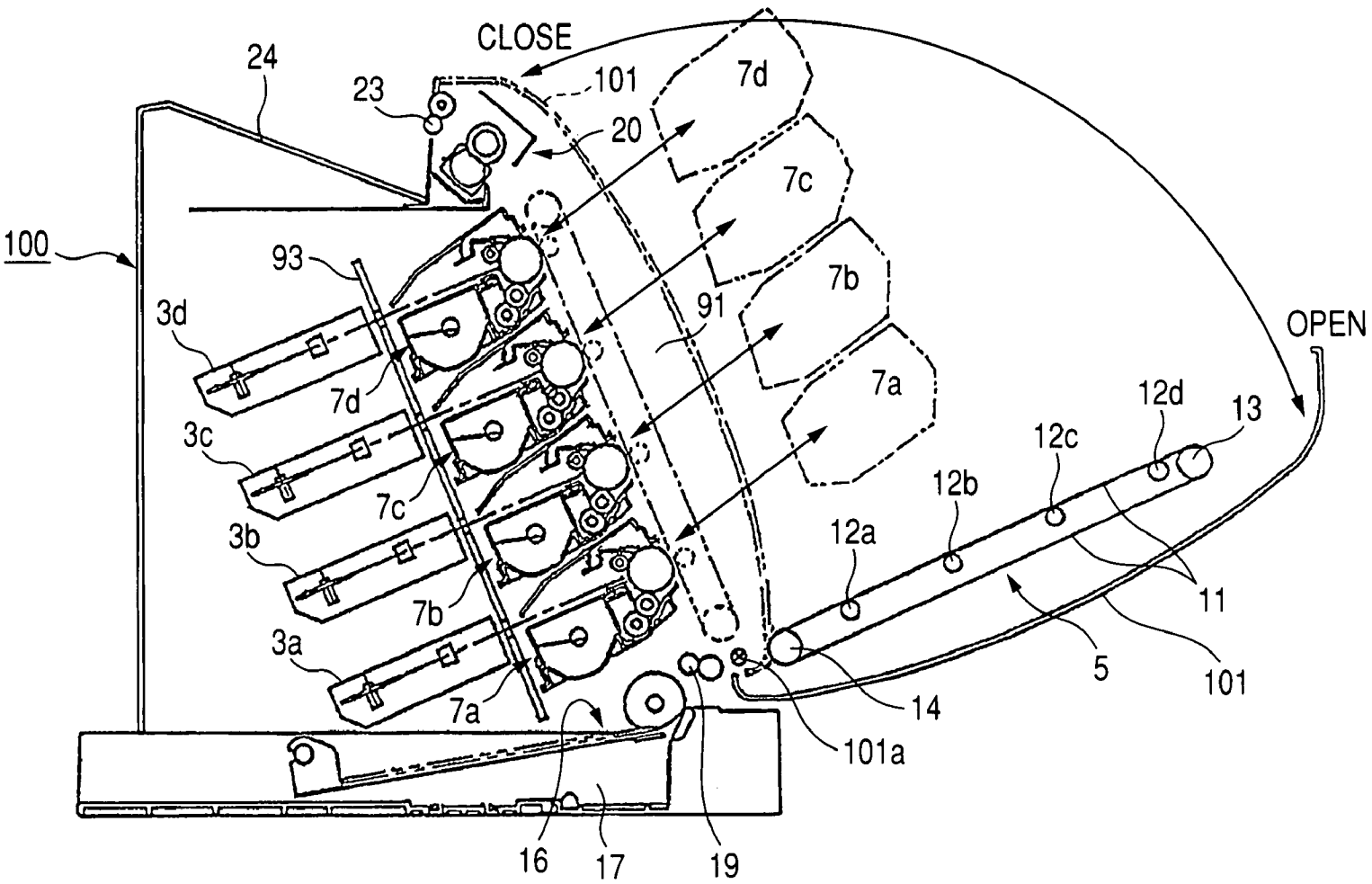
FIG. 2 is a longitudinal cross-sectional view showing a state in which the front door of the image forming apparatus according to the embodiment of the present invention is opened and a process cartridge insertion port is opened.

The apparatus front door (hereinafter referred to as the front door) 101 of an electrophotographic image forming apparatus main body (hereinafter referred to as the apparatus main body) 100 is openable and closable relative to the front surface portion of the main body 100 of the apparatus about a hinge shaft 110*a* on a lower side. FIG. 1 shows a state in which the front door 101 is closed relative to the main body 100 of the apparatus. FIG. 2 shows a state in which the front door 101 is opened toward this side and a process cartridge insertion port 91 in the apparatus main body is opened.

The reference characters 7*a*, 7*b*, 7*c* and 7*d* designate first to fourth process cartridges (hereinafter referred to as the cartridges) for forming developer images of yellow, magenta, cyan and black colors corresponding to the color-resolved component colors of a full-color image. These cartridges 7 (7*a*, 7*b*, 7*c*, 7*d*) are arranged side by side in the apparatus main body in succession from below.

The respective cartridges 7 have drum-shaped electrophotographic photosensitive members (hereinafter referred to as the photosensitive drums) 1 (1*a*, 1*b*, 1*c*, 1*d*) and charging devices (charging means) 2 (2*a*, 2*b*, 2*c*, 2*d*) for uniformly charging the photosensitive drums 1. Further, the cartridges 7 have developing devices (developing means) 4 (4*a*, 4*b*, 4*c*, 4*d*) for causing developers to adhere to electrostatic latent images formed on the photosensitive drums 1 to thereby develop the latent image as developer images. Also, the respective cartridges 7 have cleaning devices (cleaning means) 6 (6*a*, 6*b*, 6*c*, 6*d*) for removing any developers residual on the photosensitive drums 1 after the developer images have been transferred to a recording medium S.

The developers contained in the respective developing devices 4 of the first to fourth cartridges 7 are a yellow developer, a magenta developer, a cyan developer and a black developer.

Scanner units 3 (3*a*, 3*b*, 3*c*, 3*d*) as four exposing means corresponding to the four cartridges 7 apply laser beams (image rights) L to the uniformly charged surfaces of the photosensitive drums 1 (1*a*, 1*b*, 1*c*, 1*d*). That is, the laser beams L outputted from laser diodes (not shown) on the basis of image information are reflected by polygon mirrors 9 (9*a*, 9*b*, 9*c*, 9*d*) rotated at a high speed by scanner motors (not shown). The charged photosensitive drums are selectively exposed to the reflected laser beams L through imaging lenses 10 (10*a*, 10*b*, 10*c*, 10*d*). Thereby, electrostatic latent images are formed on the photosensitive drums 1 (1*a*, 1*b*, 1*c*, 1*d*).

An intermediate plate (partition wall) 93 disposed in the main body 100 of the apparatus partitions the above-described four cartridges 7 and the four scanner units 3 from each other. The laser beams L outputted from the respective scanner units 3 pass through corresponding application windows 95 provided in the intermediate plate 93 and enter the corresponding cartridge 7. The laser beams L scan the photosensitive drums 1, which are thus exposed to the laser beams L.

A transfer device (transferring means) 5 is provided inside the front door 101. The front door 101 is opened and closed relative to the main body 100 of the apparatus including this transfer device 5 (FIG. 2). In the state of FIG. 1, a transfer belt 11 is obliquely disposed in the transfer device 5. This transfer belt 11 is circulatively moved so as to be opposed to and contact with all of the photosensitive drums 1 of the first to fourth cartridges 7. Four transfer rollers 12 (12*a*, 12*b*, 12*c*, 12*d*) are provided in contact with the inner side of the transfer belt 11 so as to sandwich the transfer belt 11 between the transfer rollers 12 and the photosensitive drums 1.

A feeding portion 16 disposed in the lower portion of the main body 100 of the apparatus feeds the recording medium S to the transfer belt 11 of the transfer device 5. This feeding portion 16 has a cassette 17. A plurality of recording mediums S are contained in the cassette 17. The reference numeral 18 denotes a feed roller (semicircular roller), and the reference numeral 19 designates registration rollers.

A fixing portion 20 disposed in the upper portion of the main body 100 of the apparatus fixes developer the images of plural colors transferred to the recording medium S. The fixing portion 20 has a rotatable heating roller 21*a*, a pressure roller 21*b* brought into pressure contact therewith to thereby apply pressure to the recording medium S, etc. A sheet discharging tray portion 24 is disposed on the upper surface of the main body 100 of the apparatus, and receives the recording medium S having an image formed thereon which is discharged by sheet discharging rollers 23.

The photosensitive drums 1 are successively rotatively driven in the counter-clockwise direction of arrow in accordance with the predetermined print timing of an image forming sequence. Then, the scanner units 3 corresponding to the respective cartridges 7 are successively driven. The transfer belt 11 of the transfer device 5 is rotatively driven in a clockwise direction at a peripheral speed corresponding to the rotational peripheral speed of the photosensitive drums 1 (see FIG. 1).

The respective photosensitive drums 1, in the rotated process thereof, are uniformly primary-charged to a predetermined polarity (in the present embodiment, the minus polarity) and predetermined potential by the charging devices 2. The charged photosensitive drums 1 are image-exposed to the laser beams L modulated in conformity with the image information. As a result, electrostatic latent images corresponding to the image information are formed on the respective photosensitive drums 1.

The electrostatic latent images are developed (in the present embodiment, reversal development using minus polarity developers) by the developing devices 4. Thereby, yellow, magenta, cyan and black developer images are formed on the respective photosensitive drums 1 at predetermined sequence control timing.

On the other hand, the feed roller 18 of the feeding portion 16 is rotatively driven at the predetermined sequence control timing. Thereby, the recording mediums S in the cassette 17 are separated and fed one by one. The leading edge of the recording medium S strikes against and is received by the nip portion between the pair of registration rollers 19. Then, the recording medium S is once stopped and forms a loop. Thereafter, the pair of registration rollers 19 are rotatively driven in synchronism with the rotation of the transfer belt 11 and the writing-out positions of the developer images formed on the photosensitive drums 1. Thereby, the recording medium S is fed to the transfer belt 11 upwardly moved on the tension roller 14 side of the transfer belt 11. The recording medium S is electrostatically attracted to the surface of the transfer belt by static electricity carried by the transfer belt 11. As a result, the recording medium S is conveyed to the most downstream transferring portion by the movement of the transfer belt 11.

The recording medium S, while being thus conveyed, is subjected to the successive superimposition transfer of the developer images from the respective photosensitive drums 1 by electric fields formed between the photosensitive drums 1 (1*a*, 1*b*, 1*c*, 1*d*) and the transfer rollers 12 (12*a*, 12*b*, 12*c*, 12*d*). In the present embodiment, during the transfer, a bias of the plus polarity is applied to each of the transfer rollers 12. Thereby, the developer images of the minus polarity on the photosensitive drums 1 are transferred to the recording medium S which is in contact with the photosensitive drums 1.

The recording medium S subjected to the superimposition transfer of the developer images of the four colors is self-stripped from the transfer belt 11 by the curvature of a transfer belt driving roller 13 and is carried into the fixing portion 20. Thereafter, heat and pressure are applied to the recording medium S by the pair of rollers 21*a* and 21*b*. The developers are thus fixed to the surface of the recording medium S. Thereafter, the recording medium S is discharged to the sheet discharging tray 24 outside the main body 100 of the apparatus by the pair of sheet discharging rollers 23.

Also, in the first to fourth cartridges 7, the photosensitive drums 1 after the transfer of the developer images to the recording medium S has any residual adhering matters such as untransferred developers thereon removed by the cleaning devices 6, and are repetitively used for image reading.

(2) Process Cartridge 7

Figure 3:
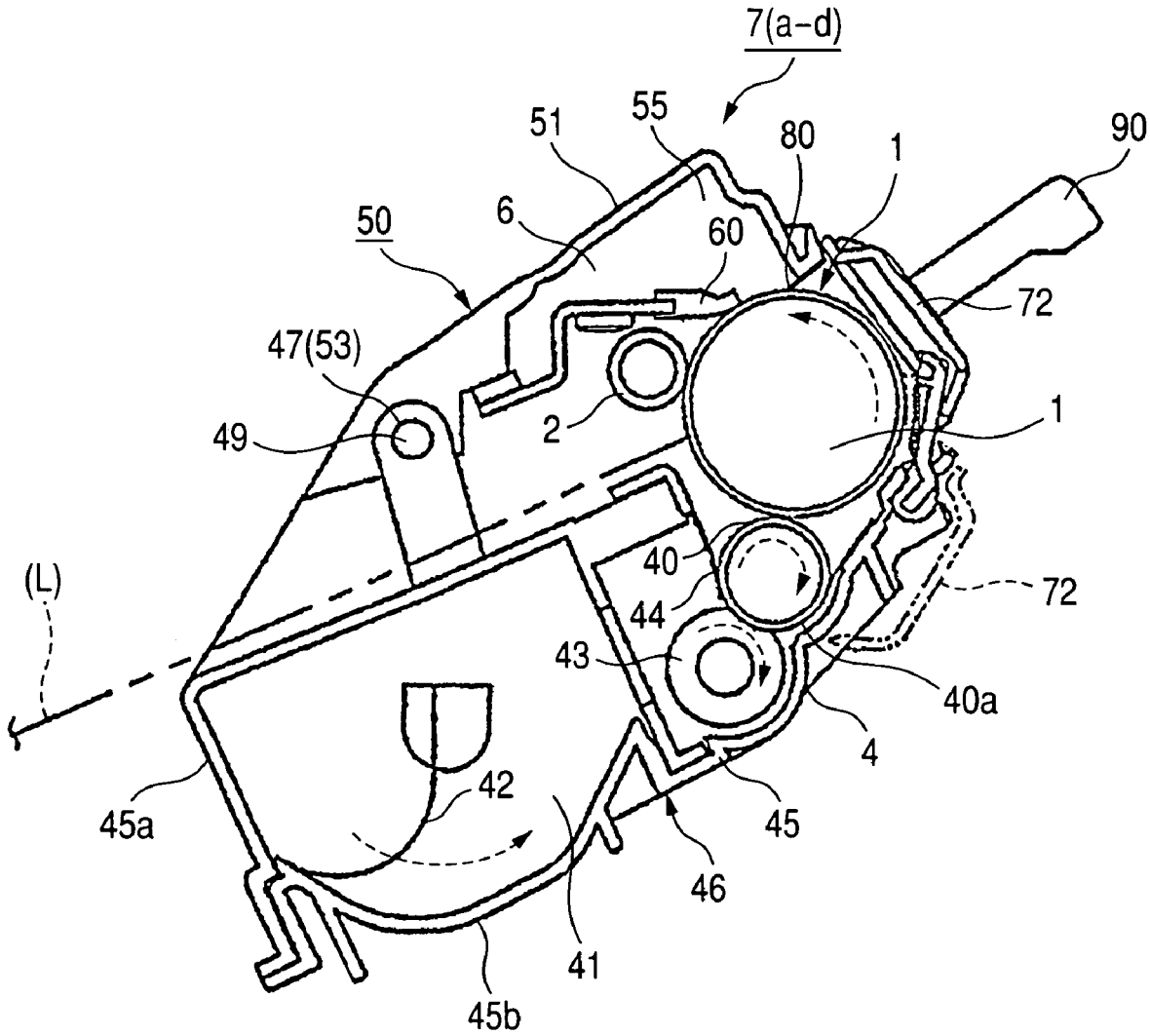
FIG. 3 is an enlarged transverse cross-sectional view of a process cartridge according to an embodiment of the present invention.
Figure 4:
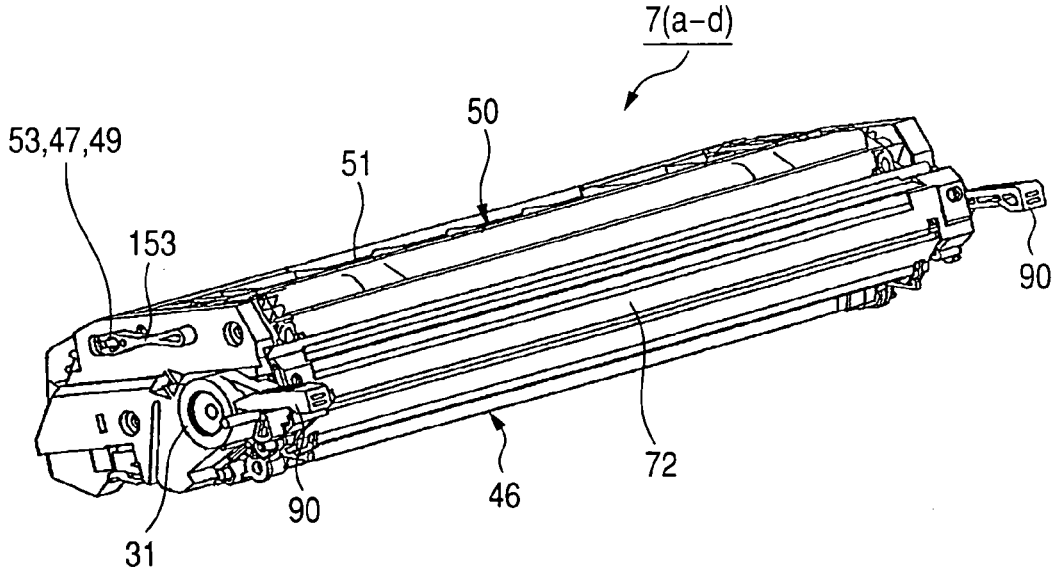
FIG. 4 is a perspective view illustrating the process cartridge according to the embodiment of the present invention.
Figure 5:
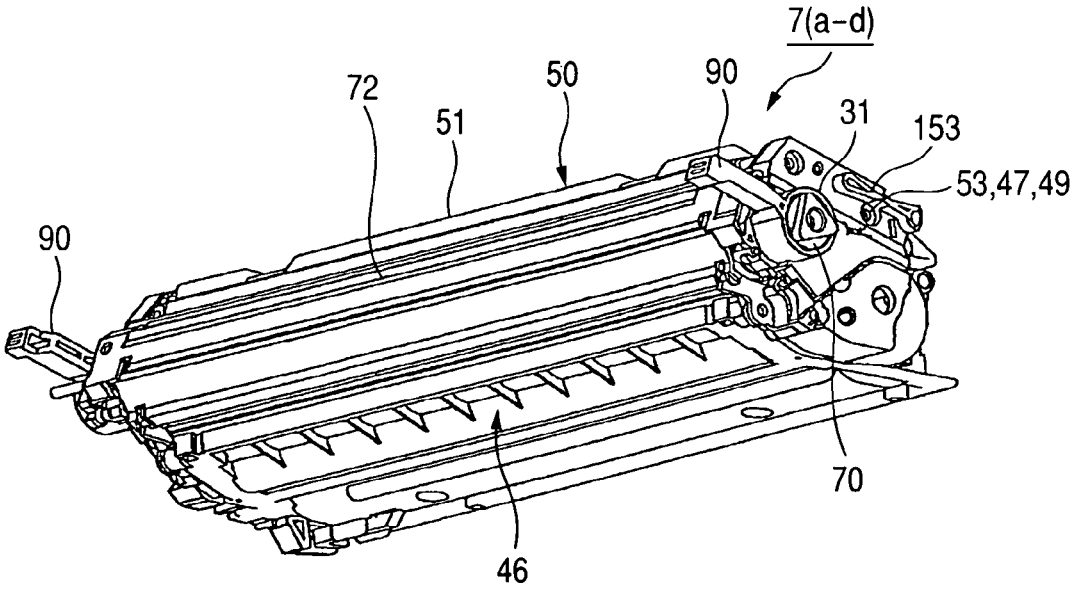
FIG. 5 is a perspective view illustrating the process cartridge according to the embodiment of the present invention.

FIG. 3 is an enlarged transverse cross-sectional view of the cartridge 7, and FIGS. 4 and 5 are perspective model views of the cartridge 7.

In the following description, the widthwise direction of the cartridge or a member constituting it is a direction in which the cartridge is mounted and dismounted with respect to the apparatus main body. Also, the lengthwise direction is a direction intersecting with the direction in which the cartridge is mounted and dismounted with respect to the apparatus main body. Regarding the cartridge, the back surface is an opposite surface of the cartridge as viewed from the front thereof, and the left or right is the left or right of the cartridge as viewed from the front thereof. Also, the upper surface of the cartridge is an overlying surface in a state in which the cartridge is mounted on the apparatus main body, and the lower surface of the cartridge is an underlying surface.

The first to fourth cartridges 7 are of the same construction with the exception that the colors of the developers contained in a developer container portion (developer containing portion) differ from one another.

Each cartridge 7 has a cleaner unit (first unit) 50 provided with the photosensitive drum 1, the charging device 2 and the cleaning device 6, and a developing unit (second unit) 46 having the developing device 4 for developing the electrostatic latent image on the photosensitive drum 1.

The cleaner unit 50 has the photosensitive drum 1, the charging device 2, a cleaning blade 60, a flexible sheet member 80, etc. disposed in a cleaning frame 51. The cleaning blade 60 removes any developer (residual developer) residual on the photosensitive drum 1 after the transfer.

The photosensitive drum 1 comprises, for example, an aluminum cylinder and a photosensitive layer provided on the outer peripheral surface thereof. The lengthwisely opposite end portions of the photosensitive drum 1 are rotatably supported by supporting members (bearing members) 31 provided on the left and right sides of the cleaning frame 51. Also, a coupling member 70 is provided on one end of the photosensitive drum 1. This coupling member 70 is coupled to a driving side coupling member (not shown) provided on the main body 100 of the apparatus side.

The charging device 2 in the present embodiment is of a contact charging type. The charging member is an electrically conductive roller formed into a roller shape. This charging member contacts with the surface of the photosensitive drum and is driven to rotate by the rotation of the photosensitive drum. Together therewith, a charging bias voltage is applied to this roller. Thereby, the photosensitive drum is uniformly charged. In the present embodiment, a reversal developing system is used and therefore, the surface of the photosensitive drum is charged to the minus polarity.

Also, the untransferred developer on the photosensitive drum passes the portion of the flexible sheet member 80 which contacts with the photosensitive drum and arrives at the location of the cleaning blade 60. The untransferred developer is then removed from the photosensitive drum 1 by the cleaning blade 60. The thus removed untransferred developer (residual developer) is contained in a residual developer chamber (residual developer containing portion) 55 provided above the cleaning blade 60. Here, the contact condition of the flexible sheet member 80 is set so that the removed residual developer may not leak out of the cleaning frame 51.

The developing unit 46 has a developing roller 40 rotated in the clockwise direction of arrow while keeping a minute gap between it and the photosensitive drum 1 by a spacer runner 40*a*, and developing frames 45*a* and 45*b* for containing the developer therein. The developing frames 45*a* and 45*b* are connected together by ultrasonic welding or the like to thereby constitute a developing container unit 45. The developing roller 40 is rotatably supported by the developing container unit 45 through a bearing member. Also, a developer supplying roller 43 rotated in the clockwise direction of arrow while being in contact with the developing roller 40 and a developing blade 44 are disposed on the periphery of the developing roller 40. Further, a developer carrying (agitating) mechanism 42 is provided in a developer container portion (developer containing portion) 41 in the developing container unit 45. This developer carrying mechanism 42 agitates the contained developer and carries it to the developer supplying roller 43.

Connecting holes 47 are formed in the lengthwisely opposite ends of the developing container unit 45. Also, supporting holes 53 are formed in the left and right sides of the cleaning frame 51 of the cleaner unit 50. Here, the connecting holes 47 and the supporting holes 53 are put together and a connecting pin 49 as a connecting member is inserted thereinto. Thereby, the developing unit 46 is pivotably connected to the cleaner unit 50. That is, the whole of the developing unit 46 is of suspended structure supported for rocking movement relative to the cleaner unit 50. Also, the developing unit 46 is always pivotally biased toward the cleaner unit 50 side about the pin 49 by a pressure spring (not shown). Thus, the spacer runner 40*a* of the developing roller 40 is in contact with the photosensitive drum 1 on the cleaner unit 50 side.

During developing, the developer contained in the developer container portion 41 is carried to the developer supplying roller 43 by the developer carrying mechanism 42. The developer supplying roller 43 rotated in the clockwise direction of arrow frictionally slides with the developing roller 40 rotated in the clockwise direction of arrow. Thereby, the developer is supplied to the developing roller 40. As a result, the developer is carried on the developing roller 40. The carried developer arrives at the location of the developing blade (layer thickness regulating member) 44 with the rotation of the developing roller 40. The developing blade 44 regulates the applied layer thickness of the developer to thereby form a predetermined thin developer layer, and imparts a desired charge amount to the developer. The developer made into a thin layer on the developing roller 40 is carried to a developing portion in which the photosensitive drum 1 and the developing roller 40 are close to each other as the developing roller 40 is rotated. In the developing portion, the electrostatic latent image formed on the surface of the photosensitive drum 1 is developed by a developing bias applied from a voltage source (not shown) to the developing roller 40. That is, the developing roller 40 shifts the developer to the low potential portion of the electrostatic latent image. Thus, a developer image is formed (developed) on the photosensitive drum 1.

Any developer which has not contributed to the developing of the electrostatic latent image and is residual on the surface of the developing roller 40 is returned into the developing device with the rotation of the developing roller 40. The thus returned developer is scraped off from the developing roller 40 in the frictional sliding portion with respect to the developer supplying roller 43 and is collected. The thus collected developer is agitated and mixed with the remaining developer by the developer carrying mechanism 42.

The reference numeral 72 designates a shutter member for protecting the photosensitive drum 1, and it is provided in the cleaning frame 51. The shutter member 72 is openable and closable to a closed position (FIGS. 3 to 5) hiding a photosensitive drum external exposed opening portion which is the front side of the cartridge 7 and an opened position (indicated by dots-and-dash line in FIG. 3) shifted downwardly from the photosensitive drum external exposed opening portion, by an opening and closing mechanism (not shown). The shutter member 72, in a state in which the cartridge 7 is taken out of the main body 100 of the apparatus, is held in its closed position. Also, the shutter member 72, when the cartridge 7 is inserted into the main body 100 of the apparatus and the front door 101 of the apparatus main body is closed, is moved to its opened position by means (not shown) operatively associated with the front door closing operation. Then, the transfer belt 11 comes into contact with the external exposed surface of the photosensitive drum 1.

Insertion guide portions 153 are provided on the left and right sides of the cleaning frame 51. A grip portion 90 used when the cartridge 7 is mounted and dismounted with respect to the main body 100 of the apparatus is provided so as to protrude from the left and right sides of the cleaning frame 51 to the front side of the cartridge.

(3) Method of Mounting and Dismounting the Cartridge 7

Figure 6:
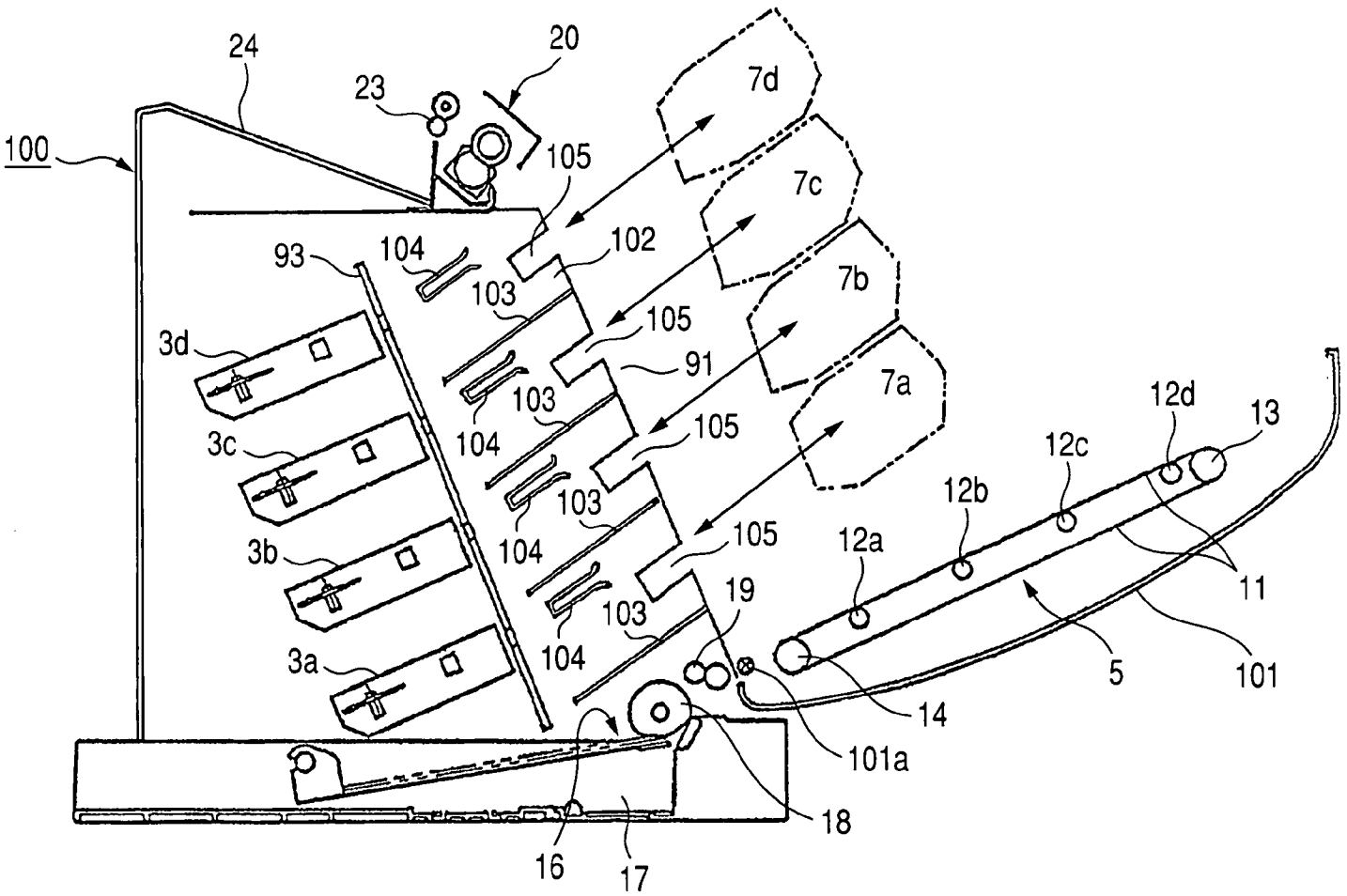
FIG. 6 is a perspective view illustrating an image forming apparatus main body according to an embodiment of the present invention during the mounting of the process cartridge thereon.

Description will now be made of a method of mounting and dismounting the cartridge 7 with respect to the main body 100 of the apparatus. As shown in FIGS. 2 and 6, the operation of mounting and dismounting each cartridge 7 with respect to the main body 100 of the apparatus is performed with the front door 101 opened and the cartridge insertion ports 91 in the apparatus main body greatly opened. The closed state (FIG. 1) of the front door 101 relative to the main body 100 of the apparatus is locked by a hooking mechanism (not shown). The locking by the hooking mechanism is released and the front door 101 including the transfer device 5 is downwardly opened to this side of the main body 100 of the apparatus about a hinge shaft 110*a* in the lower portion.

The insertion ports 91 enable the first to fourth cartridges 7 to be mounted obliquely with respect to the vertical in succession from above to below. Cartridge mounting mechanisms in the respective insertion ports are similar to one another. That is, in the respective insertion ports, rough guide portions 103, main guide portions 104 and guide grooves 105 for directing the cartridges 7 to an image forming position are disposed on the inner sides of the left and right side plates 102 of the main body 100 of the apparatus. FIG. 6 shows the inner side of the right side plate. The inner side of the left side plate is symmetrical therewith.

The operator grips the left and right grip portions 90 of the cartridge 7 with his left and right hands and holds the cartridge 7. Then, he first inserts into the insertion port the back surface side of the cartridge which is opposite to the photosensitive drum 1 side in the widthwise direction of the cartridge. Then, he places the left and right side portions of the cartridge 7 on the rough guide portions 103. When he further inserts the cartridge, the insertion guide portions 153 on the left and right side portions of the cartridge 7 ride onto the main body guide portions 104. Then, the cartridge 7 floats up from the rough guide portions 103 and is inserted and guided by the main body guide portions 104.

When the cartridge 7 is further inserted into the main body 100 of the apparatus, the left and right supporting members 31*a* and 31*b* of the cartridge 7 are inserted into the guide grooves 105. Then, the supporting members 31*a* and 31*b* strike against the ramming surfaces of the guide grooves 34 and any further insertion of the cartridge 7 is blocked. Thereby, the position of the cartridge 7 relative to the main body 100 of the apparatus in the widthwise direction is determined.

After the corresponding cartridges have been inserted into the respective insertion ports in the manner described above, the opened front door 101 is closed relative to the main body 100 of the apparatus. Then, the closed state is locked by the hooking mechanism (not shown). By means (not shown) operatively associated with this operation of closing the front door 101, 1) the urging positioning of each cartridge 7 in the main body 100 of the apparatus in the widthwise direction, 2) the movement of each cartridge 7 to the opened position of the shutter member 54, and 3) the engagement of the driving coupling member of the main body 100 of the apparatus with the coupling member 70 of each cartridge 7 are done.

In the mounted state of each cartridge with respect to the main body 100 of the apparatus as described above, the motive power transmitting coupling member on the main body 100 of the apparatus side is in engagement with the coupling member 70 of each cartridge 7. Thereby, a driving force from a driving motor (not shown) on the main body 100 of the apparatus side is transmitted to the coupling member 70. Thus, the photosensitive drum 1 of each cartridge 7 is rotatively driven counter-clockwisely (see FIG. 1). Also, in operative association with this rotation of the photosensitive drum 1, the developing roller 40, the developer carrying mechanism 42 and the developer supplying roller 43 are driven through a gear train (not shown).

Also, an electrical contact (not shown) on the cartridge 7 side and an electrical contact (not shown) on the main body 100 of the apparatus side are electrically connected together. Thereby, the application of a charging bias and a developing bias from a voltage source portion (not shown) on the main body 100 of the apparatus to the cartridge 7 side becomes possible. Also, the photosensitive drum on the cartridge 7 side is grounded to the main body 100 of the apparatus side.

The taking-out of the cartridge 7 from within the main body 100 of the apparatus is done by a procedure converse to that during the above-described mounting.

(4) Construction of a Connecting Portion between the Developing Unit 46 and the Cleaner Unit 50

Figure 7:
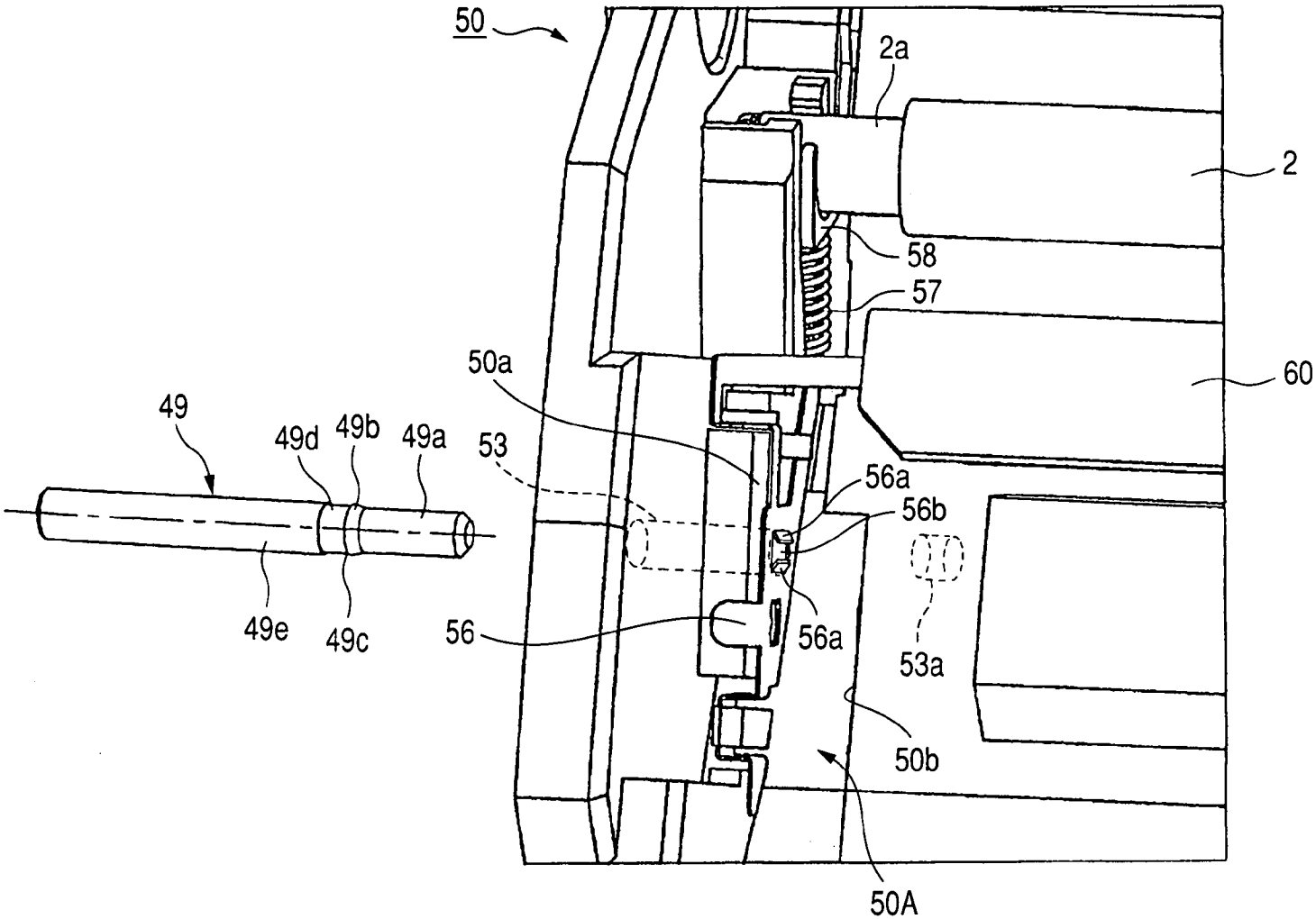
FIG. 7 is a perspective view of a connecting pin and the lengthwise left end portion of the charging bias supplying side of a cleaner unit.
Figure 8:
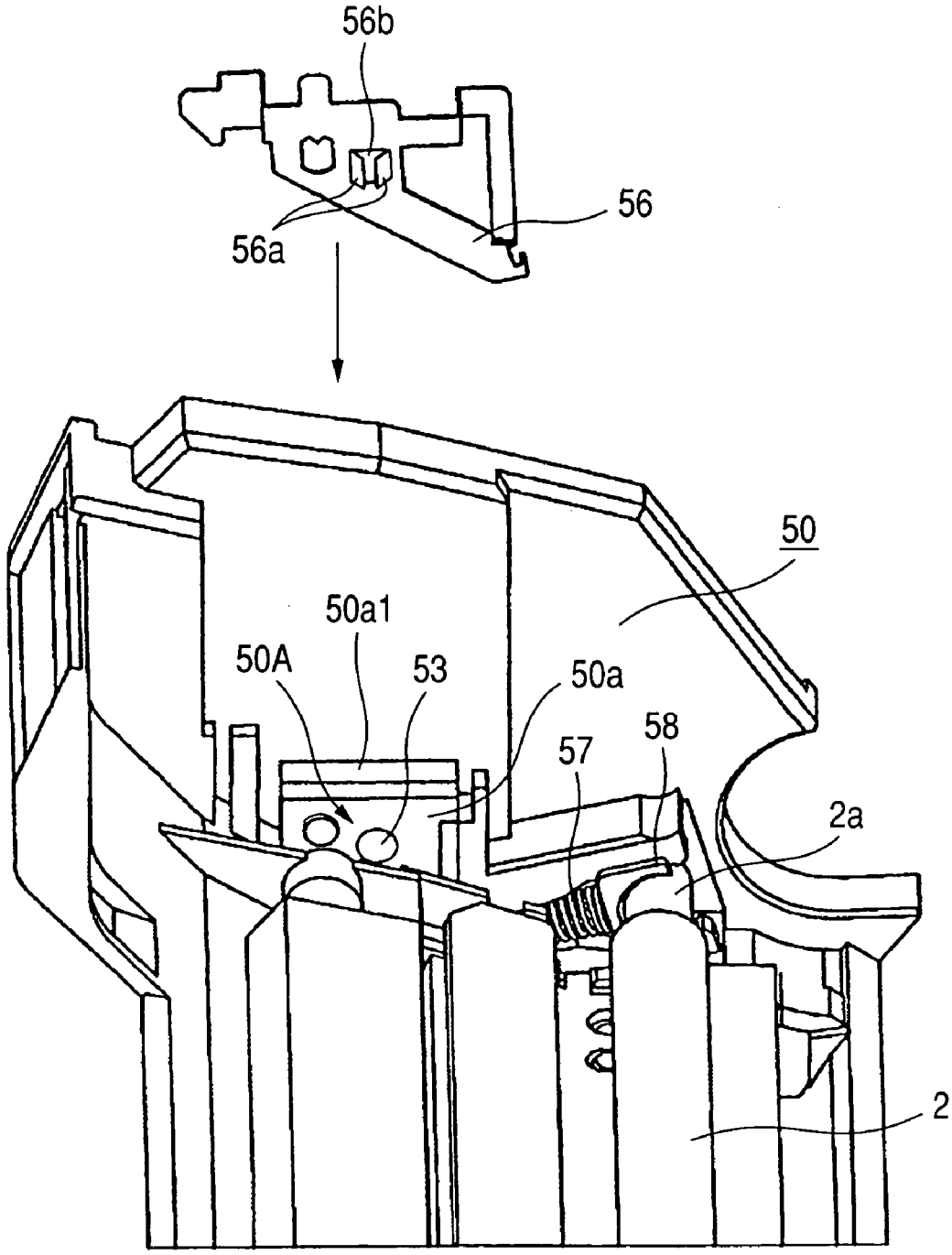
FIG. 8 is an illustration when an electrode plate is attached to the cleaner unit.
Figure 9:
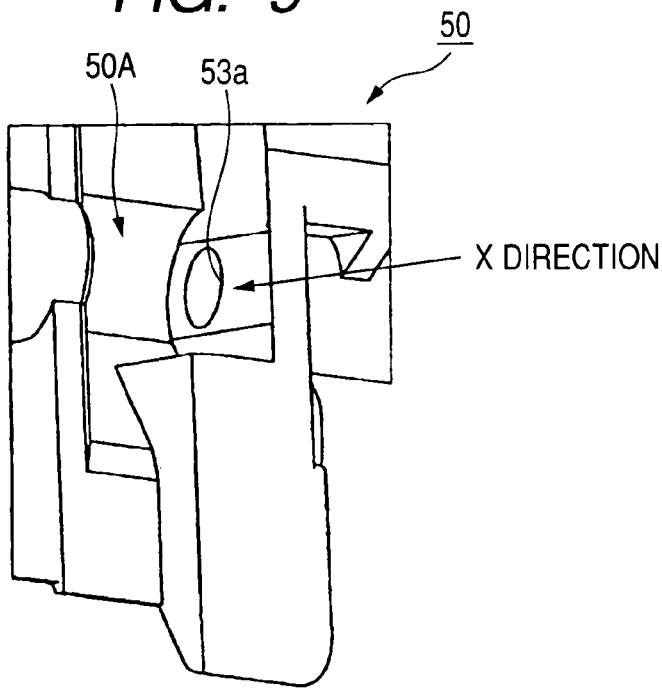
FIG. 9 is a perspective view showing a supporting hole in the cleaner unit.
Figure 10:
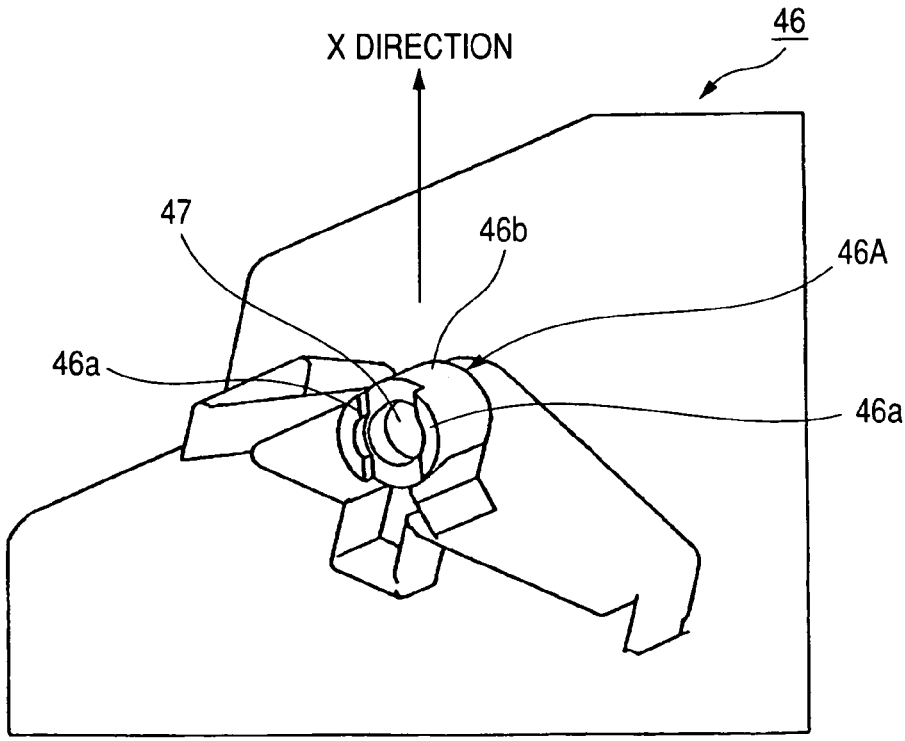
FIG. 10 is a perspective view of the lengthwise left end portion of the charging bias supplying side of a developing unit.
Figure 11:
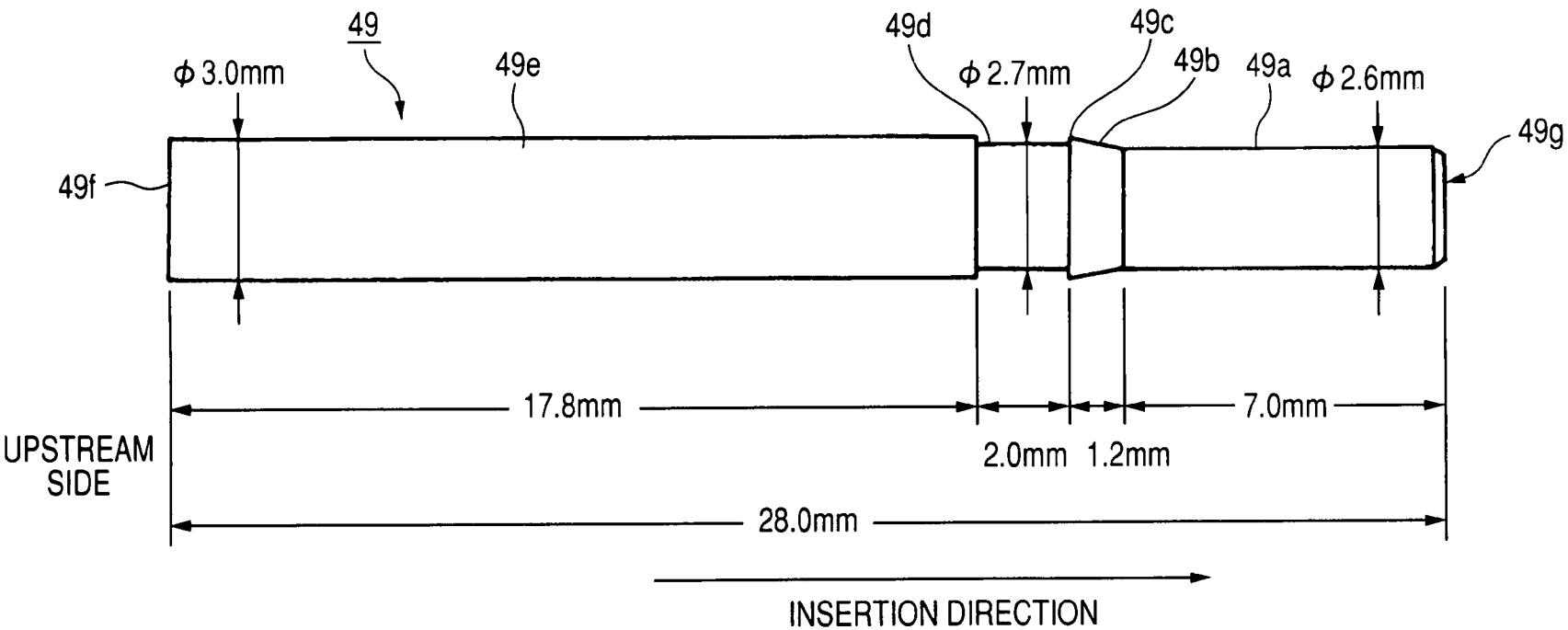
FIG. 11 is an enlarged view of the connecting pin.

FIG. 7 is a perspective view of the connecting pin 49 and the lengthwise left end portion of the charging bias supplying side of the cleaner unit 50. Also, FIG. 8 is an illustration when an electrode plate 56 as an electrically conductive member is attached to the cleaner unit 50. Further, FIG. 9 is a perspective view showing a supporting hole in the cleaner unit. FIG. 10 is a perspective view of the lengthwise left end portion of the charging bias supplying side of the developing unit 46. FIG. 11 is an enlarged view of the connecting pin 49.

Referring to FIG. 7, the connecting pin 49 is formed into a shaft shape. The connecting pin 49 has, in succession from the entry direction side (the right side in FIG. 7) into the cleaner unit 50, a fore end portion 49*a* (first column portion), a tapered portion 49*b* (inclined surface), a flange portion 49*c*, a central shaft portion 49*d* (third column portion) and a rear end portion 49*e* (second column portion). The diameter of the rear end portion 49*e* is larger than the diameter of the fore end portion 49*a*. Also, the tapered portion 49*e* is inclined so that the diameter thereof may become larger from the fore end portion 49*a* toward the rear end portion. Also, the diameter of that end portion of the tapered portion 49*b* which is adjacent to the rear end portion 49*e* is smaller than the diameter of the rear end portion 49*e*. As shown in FIG. 11, this connecting pin 49 has a full length of 28.0 mm, the length of the fore end portion 49*a* thereof is 7.0 mm, the length of the tapered portion 49*b* thereof is 1.2 mm, the length of the central shaft portion 49*d* is 2.0 mm, and the length of the rear end portion 49*e* is 17.8 mm. Also, the diameter of the fore end portion 49*a* is 2.6 mm, the diameter of the flange portion 49*c* is 3.0 mm, the diameter of the central shaft portion 49*d* is 2.7 mm, and the diameter of the rear end portion 49*e* is 3.0 mm. As the material of the connecting pin 49, use is made of a material having electrical conductivity such as a metal such as aluminum, iron, copper or stainless steel, or electrically conductive resin having electrically conductive particles of carbon, aluminum, indium oxide, titanium oxide or the like dispersed in resin such as polycarbonate, polybutylene terephthalate, polyphenylene sulfide, polyamide or polyacetal. In the present embodiment, use is made of a connecting pin 49 of a metal material.

The reference character 50A designates a recess formed in the lengthwise left end portion of the cleaner unit 50. An outer side wall 50*a* is provided on the lengthwise outer side of this recess 50A. This outer side wall 50*a* is formed with a supporting hole 53 through which the rear end portion 49*e* of the connecting pin 49 extends. Also, an inner side wall 50*b* is provided on the lengthwise inner side of the recess 50A. This inner side wall 50*b* is formed with a supporting hole 53*a* for supporting the fore end portion 49*a* of the connecting pin 49. The electrode plate 56 is formed into a predetermined shape by punching and pressing a metal plate. As shown in FIG. 8, this electrode plate 56 is inserted from the outside into the recess 50A, and is attached to an electrode plate attaching portion 50*a*1 provided on the outer side wall 50*a*. The thus attached electrode plate 56 is electrically connected to one end of an electrically conductive spring 57 provided in the cleaner unit 50. The other end of this electrically conductive spring 57 is electrically connected to an electrically conductive bearing 58. This electrically conductive bearing 58 rotatably supports the mandrel 2*a* of the charging roller 2 as the charging device. The above-described electrode plate 56 is provided with a cut-up portion 56*a* and a connecting hole (opening) 56*b*. The cut-up portion 56*a* elastically abuts against the central shaft portion 49*d* of the connecting pin 49 at a location opposed to the supporting hole 53*a* in the outer side wall 50*a*. This cut-up portion 56*a* is formed into a pair. Also, the connecting hole (opening) 56*b* is sandwiched by the cut-up portion 56*a*, and passes the central shaft portion 49*d* therethrough.

Referring to FIG. 10, a convex portion (engaging portion) 46A provided on the left end portion of the developing unit 46 is formed into a substantially cylindrical shape so as to fit in the recess 50A of the cleaner unit 50. The fitting relation between the convex portion 46A and the recess 50A is determined so as to have a gap to a degree of fit backlash in the lengthwise direction of the process cartridge 7. A pair of ramming portions 46*a* as force imparting portions provided on the convex portion 46A ram the electrically conductive member 56 against the outer side wall 50*a*. The convex portion 46A has a groove-shaped cut-away 46*b* between the ramming portions 46*a*. This convex portion 46A is formed with a connecting hole 47 through which the fore end portion 49*a* of the connecting pin 49 extends.

A recess of the same shape as the recess in the left end portion is formed in the lengthwise right end portion (not shown) of the cleaner unit 50. Also, a convex portion of the same shape as the convex portion on the left end portion is provided on the lengthwise right end portion (not shown) of the developing unit. The fitting form of the recess and the convex portion on the right end portions of the cleaner unit 50 and the developing unit 46 is the same as the fitting form of the recess and the convex portion on the left end portions thereof. Also, the recess and the convex portion on the right end portions are connected together by a connecting pin (not shown) of the same shape as the connecting pin used in the above-described left end portion. The electrode plate 56, the electrically conductive spring 57, etc. are not provided on the right end portion of the cleaner unit 50.

Figure 12:
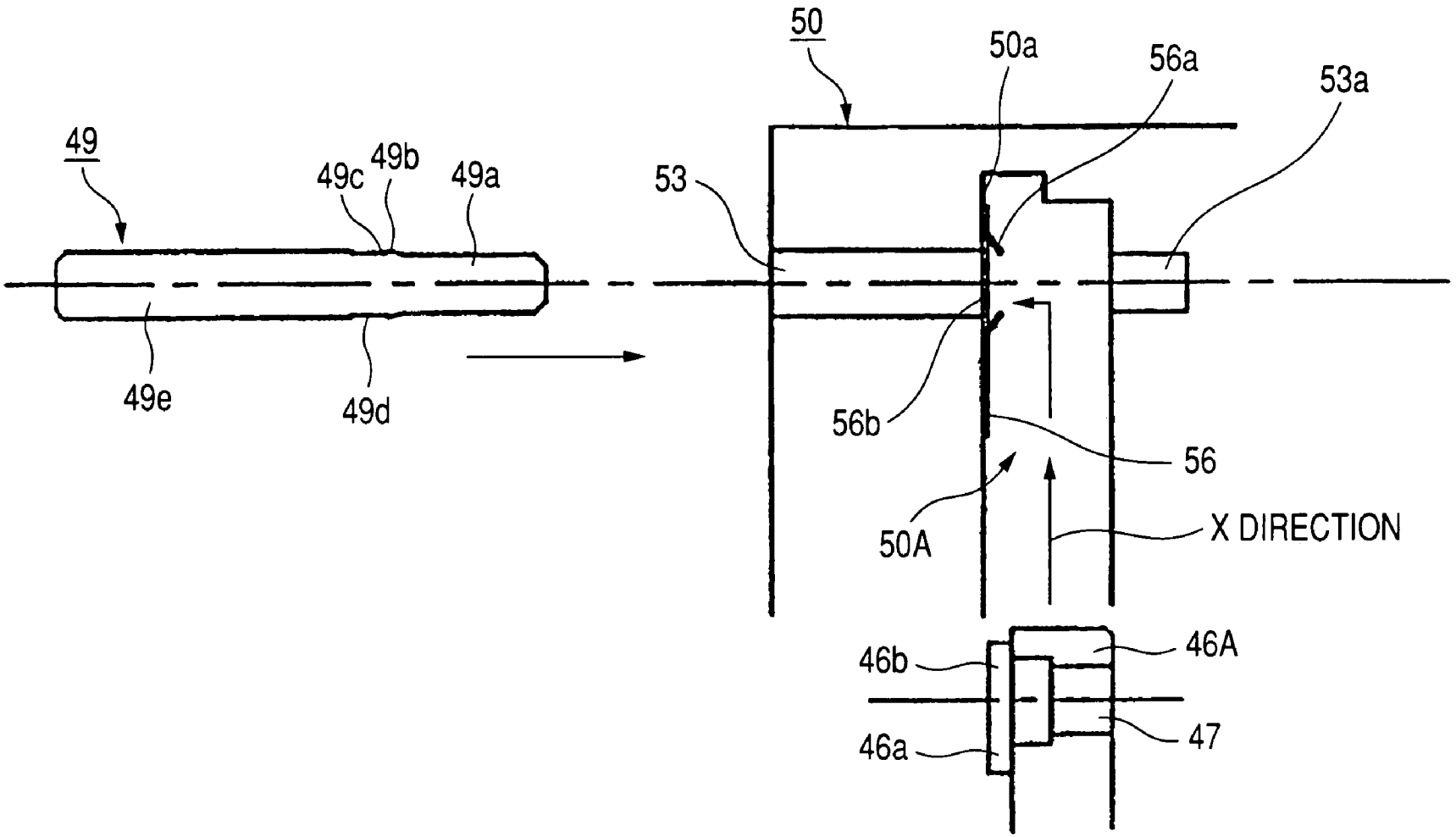
FIG. 12 is an illustration showing a method of connecting the cleaner unit and the developing unit together.
Figure 13:
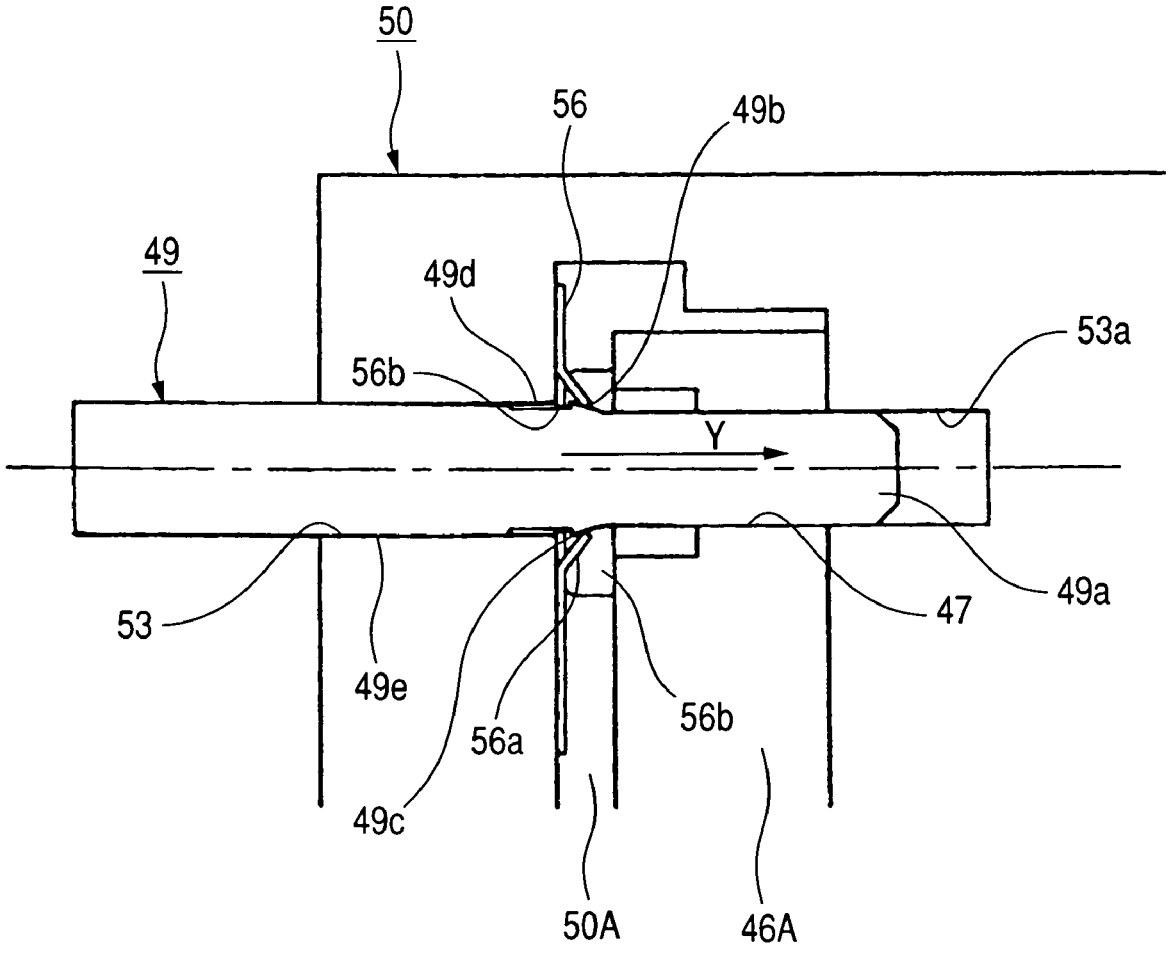
FIG. 13 is an illustration showing the method of connecting the cleaner unit and the developing unit together.

(5) Method of Connecting the Developing Unit 46 and the Cleaner Unit 50 Together Reference is now had to FIGS. 8, 12 and 13 to describe a method of connecting the developing unit 46 and the cleaner unit 50.

As shown in FIGS. 8 and 12, the electrode plate 56 is inserted into the recess 50A of the cleaner unit 50 as indicated by the direction of arrow. The electrode plate 56 is then attached to the electrode plate attaching portion 50*a*1 (see FIG. 8) provided on the outer side wall 50*a*. The electrode plate 56 is not fixed when it is attached. Intactly in that state, the convex portion 46A of the developing unit 46 is fitted into the recess 50A of the cleaner unit 50. At that time, the cut-up portion 56*a* of the electrode plate 56 is received in the cut-away 56*b* of the convex portion 46A. That is, the cut-up portion 56*a* is surrounded by the cut-away 56*b*. Thereby, the position of the electrode plate 56 relative to the cleaner unit 50 is fixed.

Next, the connecting pin 49 is inserted from the outside of the cleaner unit 50 into the supporting hole 53. As shown in FIG. 13, the connecting pin 49 is inserted into the supporting holes 53 and 53*a*. First, the tapered portion 49*g* at the insertion direction end of the pin 49 is inserted. Then, the cut-up portion 56*a* rides across the tapered portion 49*b* provided on the pin 49. When the pin is further inserted, the cut-up portion 56*a* rides across the flange portion 49*c* provided on the connecting pin 49. At that time, the electrode plate 56 is dragged by the movement of the connecting pin 49 in the insertion direction thereof (Y direction) and tends to move toward the convex portion 46A side (Y direction). That movement, however, is regulated by the end surfaces of the ramming portions 46*a* striking against the plane portion 56*c* (the portion provided on the outside of the cut-up portion 56*a* and the connecting hole 56*b*) of the electrode plate 56. Thereafter, the cut-up portion 56*a* elastically abuts against the central shaft portion 49*d* smaller in the shaft diameter than the rear end portion 49*e* of the connecting pin 49. Thereby, the central shaft portion 49*d* and the cut-up portion 56*a* are electrically connected together (see FIG. 14). In this state, the fore end portion 49*a* of the connecting pin 49 is restrained in the supporting hole 53*a* formed in the cleaner unit 50. Also, the tapered portion 49*b* fits in the connecting hole 47 formed in the developing unit 46. Further, the central shaft portion 49*d* fits in the connecting hole 56*b* formed in the electrode plate 56. Further, the rear end portion 49*e* fits in the supporting hole 53 formed in the cleaner unit 50. Here, there is a fit backlash among the ramming portion 46*a*, the outer side wall 50*a* and the electrode plate 56. However, by the connecting pin 49 being inserted, the plane portion 56*c* is rammed against the ramming portion 46*a*. Thereby, the developing unit 46 and the cleaner unit 50 have their lengthwisely opposite ends pivotally connected together by the connecting pin 49. Thus, the developing unit 46 and the cleaner unit 50 are made integral with each other. Here, in the connecting pin 49, the flange portion 49*c* which is the largest diameter of the tapered portion 49*b* is at right angles with respect to the peripheral surface of the rear end portion 49*e* and has a diameter smaller than or equal to the diameter of the rear end portion 49*e*. Therefore, when the connecting pin 49 tends to move in a direction opposite to the insertion direction thereof, the cut-up portion 56*a* of the electrode plate 56 contacts with the right-angle surface of the flange portion 49*c*. By this contact, the movement of the connecting pin 49 in the opposite direction is regulated. By the connecting pin 49 and the electrode plate 56 being made into the shapes as described above, the insertion force of the connecting pin 49 can be suppressed considerably lower than the pulling-out force thereof. Accordingly, this connecting pin 49 is designed to be easy to insert in order to connect the developing unit 46 and the cleaner unit 50 together and moreover, is designed to be difficult to pull out after the two units have been connected together.

Figure 16:
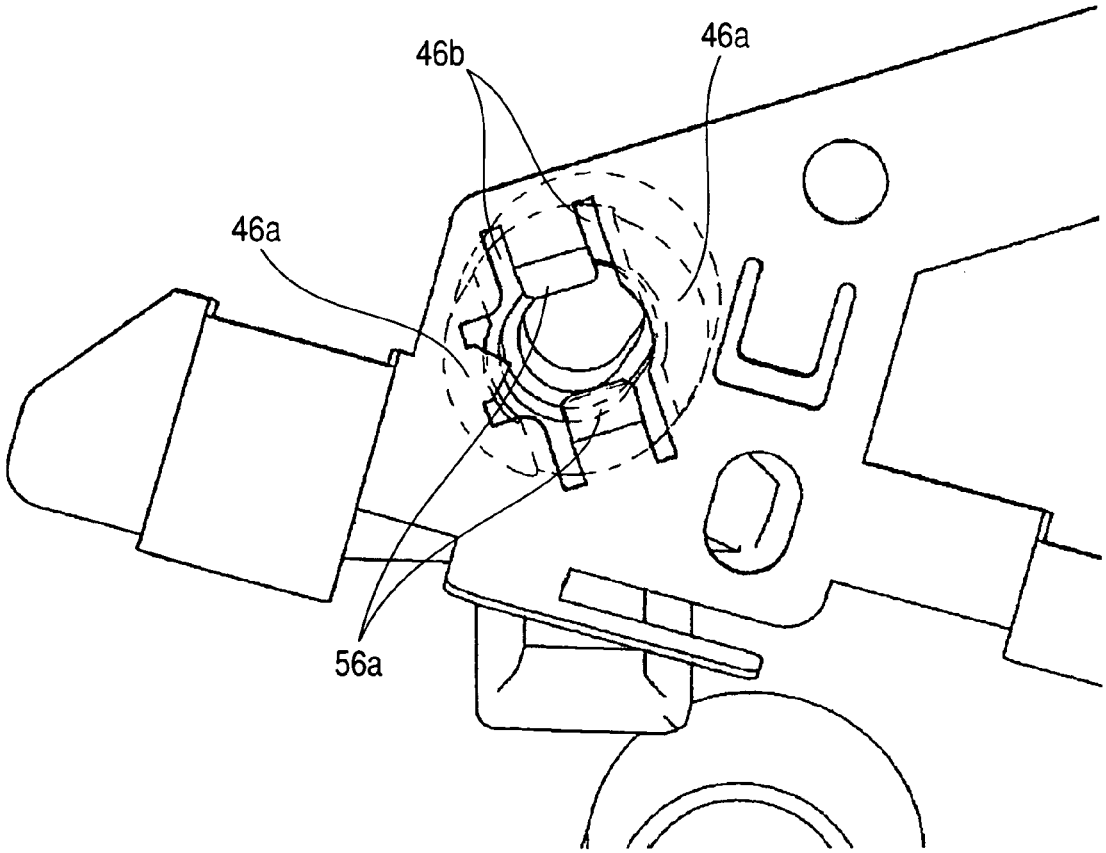
FIG. 16 is a view of the electrode plate and a convex portion as it is seen from the electrode plate side when the developing unit and the cleaner unit have been connected together.

Reference is now had to FIG. 16 to describe the relation between the cut-away 46*b* and the cut-up portion 56*a* when the developing unit 46 and the cleaner unit 50 have been connected together. FIG. 16 is a view of the electrode plate 56 and the convex portion 46A as it is seen from the electrode plate 56 when the developing unit 46 and the cleaner unit 50 have been connected together. The ramming portions 46*a* and the cut-away 46*b* are indicated by dotted lines. The cut-away 46*b* is designed to receive the cut-up portion 56*a* therein when the two units have been connected together. Also, the cut-away direction of the cut-away 46*b* coincides with a direction (X direction) in which the convex portion 46A is inserted into the recess 50A. Accordingly, design is made such that the cut-up portion 56*a* does not abut against the ramming portions 46*a* when the convex portion 46A is inserted into the recess 50A. In other words, design is made such that the cut-up portion 56*a* enters into between the ramming portions 46*a*.

Figure 15:
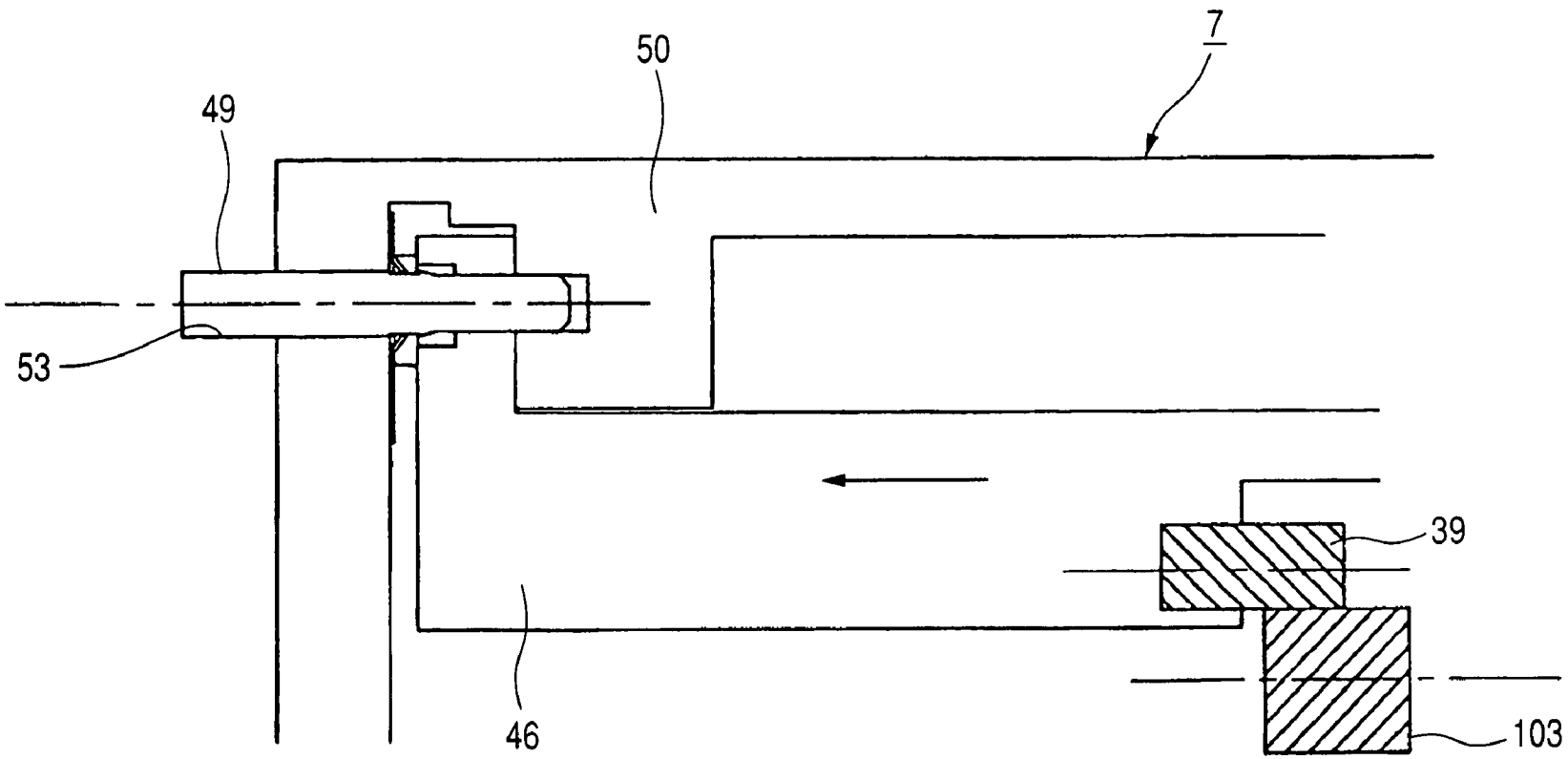
FIG. 15 is an illustration showing a state in which a driving force is inputted from the main body side driving member of the image forming apparatus main body to the driving input member of the developing unit.

When as shown in FIG. 15, the cartridge 7 is mounted on the image forming main body 100 of the apparatus, the driving input member 39 provided in the developing unit 46 in the lengthwise direction of the cartridge 7 and a main body side driving member 103 provided in the main body 100 of the apparatus come into meshing engagement with each other. Further, as the driving input member 39, use is made of such a gear form as will move the developing unit 46 relative to the cleaner unit 50 by a predetermined amount toward the connecting pin side when it receives a rotational force from the main body side driving member 103. In the present embodiment, a helical gear is used as the driving input member 39. In the state in which the driving input member 39 and the main body side driving member 103 are in meshing engagement with each other, pre-multirotation before image forming (the preparatory rotating operation period before image forming from the ON of a print signal until the image forming (printing) operation is actually performed) is effected. Therefore, the main body side driving member 103 is rotatively driven through a driving system (not shown), and when the driving force thereof is inputted to the driving input member 39, the developing unit 46 receives a force in the direction of arrow in FIG. 15. That is, the developing unit 46 receives a force in a direction to ram the electrode plate 56 against the cleaner unit 50. Further, in other words, the developing unit 46 and the cleaner unit 50 move relative to each other in the lengthwise direction thereof, whereby the ramming portions 46*a* of the developing unit 46 abut against the plane portion 56*c* of the electrode plate 56. As a result, the plane portion 56*c* is urged against the outer side wall 50*a* of the cleaner unit 50. Thereby, the cut-up portion 56*a* of the electrode plate 56 urges the connecting pin 49. That is, by the plane portion 56*c* being urged, the abutting pressure of the cut-up portion 56*a* against the pin 49 can be heightened. Thereby, the positional relation d the electrical connectability between the electrode plate 56 and the connecting pin 49 are stabilized. Summing up, the ramming portions 46*a* give the electrode plate 56 an urging force for the cut-up portion 56*a* to urge the connecting pin 49. Also, in the present embodiment, the helical gear receives the urging force from the main body driving member 103.

In the present embodiment, when it receives the urging force, the cleaner unit 56 is not moved relative to the main body 100 of the apparatus. On the other hand, the developing unit 46 is moved relative to the main body 100 of the apparatus by the urging force. Thereby, in the present embodiment, the developing unit 46 and the cleaner unit 50 are moved relative to each other in the lengthwise direction thereof. However, the cleaner unit 50 may be moved and the developing unit 46 may not be moved, whereby the developing unit 46 and the cleaner unit 50 may be moved relative to each other in the lengthwise direction thereof. Also, by using the resilient force of a spring instead of the thrust force of the helical gear, the developing unit 46 and the-cleaner unit 50 may be moved relative to each other in the lengthwise direction thereof. In the present embodiment, the unit having the photosensitive drum 1 is fixed to the main body 100 of the apparatus, whereby the image position can be determined more highly accurately. Also, in the present invention, the mutual units can be moved relative to each other by the use of the thrust force of the bevel gear and therefore, urging means for moving the units relative to each other need not be newly provided.

Figure 14:
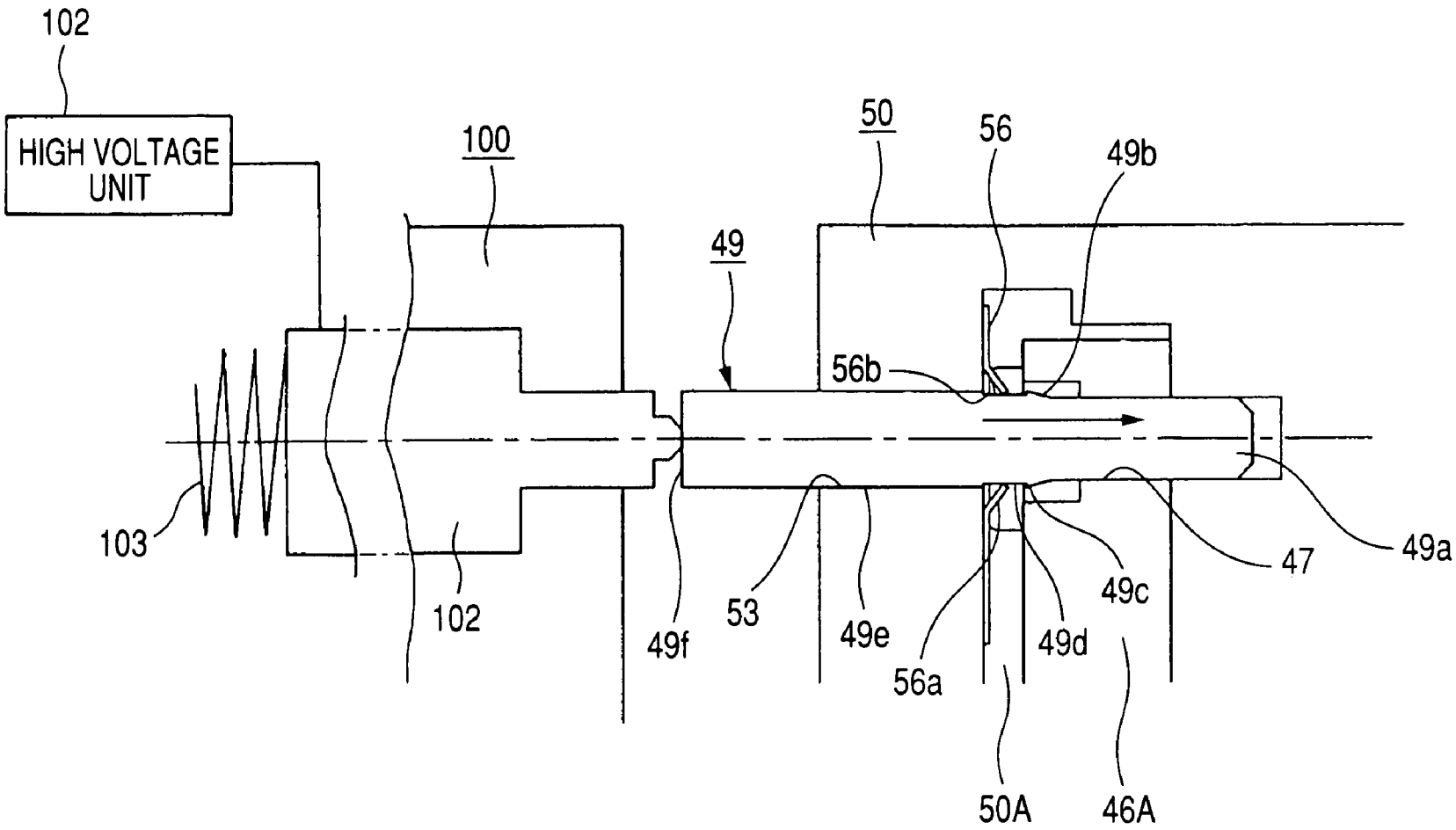
FIG. 14 is an illustration of a construction for supplying electric power to the connecting pin which has connected the cleaner unit and the developing unit together.

As shown in FIG. 14, the connecting pin 49 is electrically connected to the high voltage unit (main body electrical contact) 102 of the image forming main body 100 of the apparatus. When the process cartridge 7 is mounted at a predetermined mounting position in the main body 100 of the apparatus, the fore end of the high voltage unit 102 abuts against the flat end surface (abutting surface) 49*f* of the rear end portion 49*e* of the connecting pin 49. The high voltage unit 102 is biased toward the process cartridge 7 side by a coil spring 103. A high-voltage current is applied to the electrode plate 56 of the process cartridge 7 through the connecting pin 49, whereby the supply of electric power to the charging device 2 is effected.

The above-described process cartridge assembling method may be summed up as follows.

(1) First, in order to connect the first unit (cleaner unit) and the second unit (developing unit) together, the engaging portion (convex portion) the second unit has is caused to enter the second unit.

Then, the connecting member (connecting pin) for rotatably connecting the first unit and the second unit together is restrained in the restraining portion (engagement hole) of the first unit, in a state astride of the outer wall of the first unit and the engaging portion.

Further, the connecting member is caused to abut against the electrically conductive member (electrode plate).

Here, when the connecting member is to be brought into contact with the electrically conductive member, the electrically conductive member tending to be moved by the ramming portions provided on the engaging portion is regulated and yet, the connecting member is brought into contact with the electrically conductive member to thereby connect the first unit and the second unit together.

(2) When the electrophotographic photosensitive drum, the charging member (charging roller) for charging the electrophotographic photosensitive drum and the process cartridge have been mounted on the electrophotographic image forming apparatus main body, in order that the first unit (cleaner unit) for supporting the electrically conductive member (electrode plate) for applying a charging bias received from the electrophotographic image forming apparatus main body to the charging member and the second unit (developing unit) for supporting the developing member (developing roller) for developing the electrostatic latent image formed on the electrophotographic photosensitive drum may be connected together, an engaging portion (convex portion) the second unit has is caused to enter the second unit. Then, the connecting member (connecting pin) for rotatably connecting the first unit and the second unit together is caused to pass through the outer wall of the first unit and the engaging portion and is restrained in the restraining portion (engagement hole) of the first unit.

Further, the connecting member is caused to abut against the electrically conductive member.

Here, when the connecting member is to be caused to abut against the electrically conductive member, the electrically conductive member tending to be moved by the engaging portion is regulated and yet, the connecting member is caused to abut against the electrically conductive member to thereby connect the first unit and the second unit together.

<Others>

1) As the developing method, use can be made of one of various developing methods such as the known two-component magnetic brush method, the cascade developing method, the touch-down developing method and the cloud developing method.

2) Also, as the construction of the charging means, the so-called contact charging method has been used in the aforedescribed embodiment, but, as other construction, use may of course be made of a heretofore used construction in which a metal shield such as aluminum is provided on three-fourths of the periphery of a tungsten wire, and positive or negative ions produced by a high voltage being applied to the tungsten wire are moved to the surface of a photosensitive drum to thereby uniformly charge the surface of this drum.

As the charging means, besides the roller type, use may be made of a blade (charging blade), a pad type, a block type, a rod type, a wire type or the like.

3) Also, as a cleaning method for the developer residual on the photosensitive drum, cleaning means may be constituted by the use of a blade, a fur brush, a magnetic brush or the like.

According to the present invention, there can be provided a process cartridge which has enhanced the reliability of electric power supply to process means, a method of assembling the process cartridge, and a connecting member used for the assembly of the process cartridge.

Also, according to the present invention, again in a construction wherein a connecting member used for the assembly of a process cartridge is used as an electric power supplying member, there can be provided a process cartridge easy to assemble, a method of assembling the process cartridge, and a connecting member used for the assembly of the process cartridge.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application Nos. 2004-099504 filed on Mar. 30, 2004 and 2004-273534 filed on Sep. 21, 2004, which are hereby incorporated by reference herein.

What is claimed is:

1. A process cartridge detachably mountable on a main body of an electrophotographic image forming apparatus, said process cartridge comprising:

an electrophotographic photosensitive member;

process means for acting on said electrophotographic photosensitive member;

a first unit for supporting said electrophotographic photosensitive member and said process means;

a second unit pivotally connected to said first unit;

an electrically conductive connecting member provided astride of said first unit and said second unit so as to pivotally connect said first unit and said second unit together, and receiving a bias to be supplied from said main body to said process means when said process cartridge is mounted on said main body;

an electrically conductive member provided in contact with said connecting member to supply said bias received by said connecting member to said process means when said process cartridge is mounted on said main body, said electrically conductive member being provided in said first unit; and a force imparting portion for imparting, by said first unit and said second unit being moved relative to each other in a lengthwise direction thereof, to said electrically conductive member an urging force with which said electrically conductive member urges said connecting member, said force imparting portion being provided in said second unit.

2. A process cartridge according to claim 1, wherein said process means is a charging member for charging said electrophotographic photosensitive member, said second unit has a developing roller for developing an electrostatic latent image formed on said electrophotographic photosensitive member, and a helical gear on one end of said developing roller for moving said second unit in a direction in which said electrically conductive member urges said connecting member by a thrust force produced when said developing roller is rotated by receiving a driving force for rotating said developing roller, and said helical gear receives said urging force from said main body.

3. A process cartridge according to claim 1, wherein said process means is a charging member for charging said electrophotographic photosensitive member, and/or a developing roller for developing an electrostatic latent image formed on said electrophotographic photosensitive member.

4. A process cartridge according to claim 1, wherein said electrically conductive member is attached to an inner wall of said first unit, said electrically conductive member has an opening in a portion thereof, and a cut-up being in elastic contact with a portion of a peripheral surface of said connecting member extending through said opening, and said cut-up being dragged by the movement of said connecting member and tending to move in a direction away from said connecting member when said connecting member contacts with said cut-up is regulated by said force imparting portion.

5. A process cartridge according to claim 1, wherein said force imparting portion is a cylinder, said connecting member extends through said cylinder, said electrically conductive member and a portion of said first unit, and said electrically conductive member is urged against said first unit by an end surface of said cylinder.

6. A method of assembling a process cartridge detachably mountable on an electrophotographic image forming apparatus, said method comprising:

a force imparting portion entering step of causing a force imparting portion of a second unit to enter a first unit; and a connecting member attaching step of causing an electrically conductive connecting member for pivotally connecting said first unit and said second unit together to extend through said force imparting portion, and bringing an electrically conductive member provided in said second unit and said connecting member into contact with each other, and regulating said electrically conductive member tending to be moved by said force imparting portion when said connecting member is brought into contact with said electrically conductive member, and yet bringing said connecting member into contact with said electrically conductive member to thereby connect said first unit and said second unit together.

7. A connecting member for pivotally connecting a first unit and a second unit of a process cartridge detachably mountable on a main body of an electrophotographic image forming apparatus, said connecting member comprising:

a first column portion provided on a fore end side in an insertion direction in which said connecting member is inserted astride of said first unit and said second unit to connect said second unit and said first unit having an electrophotographic photosensitive member and process means for acting on said electrophotographic photosensitive member;

a second column portion provided on a rear end side in said insertion direction, and having a diameter larger than a diameter of the first column portion;

an inclined surface inclined from said first column portion toward said second column portion between said first column portion and said second column portion, a diameter of an end portion of said inclined surface on a side of said second column portion being smaller than the diameter of said second column portion; and a third column portion located between said inclined surface and said second column portion, and contacted with by a portion of an electrically conductive member provided in said first unit to supply a bias received from said main body to said process means when said connecting member is inserted into said first unit and said second unit, wherein the end portion of said inclined surface on the side of said second column portion is substantially at right angles with respect to a peripheral surface of said third column portion, and when said connecting member tends to move by a predetermined distance or greater from within said first unit and said second unit in a direction opposite to said insertion direction, a portion of said electrically conductive member contacts with the end portion of said inclined surface on the side of said second column portion to thereby regulate a further movement of said connecting member.

* * * * *

UNITED STATES PATENT AND TRADEMARK OFFICE

CERTIFICATE OF CORRECTION

PATENT NO. : 7,072,601 B2
APPLICATION NO. : 10/957616
DATED : July 4, 2006
INVENTOR(S) : Masaki Kakitani et al.

It is certified that error appears in the above-identified patent and that said Letters Patent is hereby corrected as shown below:

COLUMN 1:
Line 57, “the-developing” should read --the developing--.
Line 58, “supplying-electric” should read --supplying electric--.

COLUMN 12:
Line 66, “the-cleaner” should read --the cleaner--.

Signed and Sealed this

Tenth Day of July, 2007

JON W. DUDAS
*Director of the United States Patent and Trademark Office*